US009221270B2

(12) United States Patent
Ishii et al.

(10) Patent No.: US 9,221,270 B2
(45) Date of Patent: Dec. 29, 2015

(54) PRINTER

(71) Applicant: FUJITSU COMPONENT LIMITED, Tokyo (JP)

(72) Inventors: Yuya Ishii, Tokyo (JP); Sumio Watanabe, Tokyo (JP); Yukihiro Mori, Tokyo (JP); Yoshinari Takabatake, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/497,870

(22) Filed: Sep. 26, 2014

(65) Prior Publication Data

US 2015/0092003 A1 Apr. 2, 2015

(30) Foreign Application Priority Data

Oct. 2, 2013 (JP) ..... 2013-207556

(51) Int. Cl.
*B41J 2/325* (2006.01)
*B41J 2/32* (2006.01)
*B41J 15/04* (2006.01)

(52) U.S. Cl.
CPC *B41J 2/32* (2013.01); *B41J 15/042* (2013.01); *B41J 15/046* (2013.01)

(58) Field of Classification Search
USPC ..... 347/220–222, 197–198, 171, 104
See application file for complete search history.

(56) References Cited

U.S. PATENT DOCUMENTS 6,061,076 A * 5/2000 Ishii ..... B41J 11/20 347/197
8,408,829 B2 * 4/2013 Kawaguchi et al. ..... 347/198
2014/0234558 A1 8/2014 Ikeda et al.

FOREIGN PATENT DOCUMENTS

JP 2000-052613 2/2000
JP 2008-284738 11/2008
JP 2013-121718 6/2013

* cited by examiner

*Primary Examiner* — Kristal Feggins
(74) *Attorney, Agent, or Firm* — IPUSA, PLLC

(57) ABSTRACT

A printer includes a platen roller, a print head that performs printing on a recording sheet, and a recording sheet guide provided on the same side as the platen roller relative to the recording sheet. Multiple projections are provided on a surface of the recording sheet guide. The projections are elongated in substantially the same direction as a conveyance direction of the recording sheet.

4 Claims, 4 Drawing Sheets

PRINTER

CROSS-REFERENCE TO RELATED APPLICATION

The present application is based upon and claims the benefit of priority of Japanese Patent Application No. 2013-207556, filed on Oct. 2, 2013, the entire contents of which are incorporated herein by reference.

BACKGROUND OF THE INVENTION

1. Field of the Invention

The present invention relates to printers.

2. Description of the Related Art

Printers that output receipts are widely used for shop registers and automated teller machines (ATMs) or cash dispensers (CDs) in banks. In such printers that output receipts, printing is performed on thermal paper serving as recording sheet or recording paper with a thermal head while conveying the recording paper, and after conveying the recording paper a predetermined length, the recording paper is cut by a cutter to the predetermined length.

In such printers, the recording paper is held between the thermal head and the platen roller, and printing is performed with the thermal head on the recording paper held between the thermal head and the platen roller.

Some printers are capable of performing printing on not only common thermal paper but also linerless labels that are labels having glue on their backsides without a release liner (backing paper).

Reference may be made to, for example, Japanese Laid-Open Patent Applications No. 2000-52613, No. 2008-284738, and No. 2013-121718 for related art.

SUMMARY OF THE INVENTION

According to an aspect of the present invention, a printer includes a platen roller, a print head that performs printing on a recording sheet, and a recording sheet guide provided on the same side as the platen roller relative to the recording sheet. Multiple projections are provided on a surface of the recording sheet guide. The projections are elongated in substantially the same direction as a conveyance direction of the recording sheet.

DESCRIPTION OF THE EMBODIMENTS

Figure 1A:
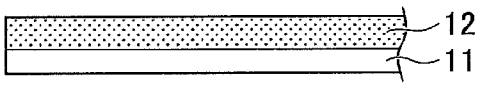
FIGS. 1A, 1B and 1C are diagrams illustrating recording paper subjected to printing in printers.

One or more embodiments of the present invention are described. In the following description, the same elements are referred to by the same reference numeral, and their description is not repeated.

First, recording paper used in thermal printers is described with reference to FIGS. 1A, 1B and 1C.

FIG. 1A illustrates common thermal paper. Referring to FIG. 1A, a heat-sensitive layer 12 is formed on paper 11 that serves as a base. Printing by a thermal head is performed on the heat-sensitive layer 12.

Figure 1B:
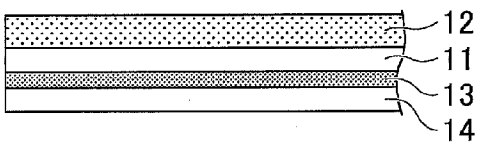

FIG. 1B illustrates label paper with a liner having glue and a release liner on the backside of the label paper. Referring to FIG. 1B, the heat-sensitive layer 12 is formed on one surface of the paper 11 serving as a base, and an adhesive layer 13 is formed on the other surface of the paper 11 by glue or the like. A release liner 14 is applied to the adhesive layer 13. When printing is performed on the label paper with a liner illustrated in FIG. 1B, printing is performed with a thermal head provided on the heat-sensitive layer 12 with the release liner 14 being applied to the adhesive layer 13. After the label paper is discharged, the release liner 14 is removed to expose the adhesive layer 13. Accordingly, in the case of label paper with a liner, in thermal printers, printing by a thermal head is performed with the release liner 14 being applied. Therefore, in the case of label paper with a liner, normally, no paper jam due to adhesion of label paper is caused in thermal printers.

Figure 1C:
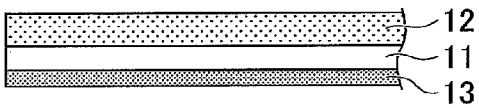

FIG. 1C illustrates linerless label paper 10 having glue but no release liner on the backside of the paper. In the following description, linerless label paper with glue on the backside may be referred to as "linerless label(s)." Linerless labels are preferred in light of environmental protection because linerless labels do not require release liners and thus turn no release liners into waste, compared with label paper with a release liner.

Referring to FIG. 1C, the heat-sensitive layer 12 is formed on one surface of the paper 11 serving as a base, and the adhesive layer 13 is formed on the other surface of the paper 11 by glue or the like. No release liner is applied to the adhesive layer 13. Therefore, in the case of performing printing on the linerless label illustrated in FIG. 1C with a thermal head, printing is performed with a thermal head on the heat-sensitive layer 12 with the adhesive layer 13 being exposed. Accordingly, at the time of printing, the linerless label may stick to a platen roller or other members inside a thermal printer so as to cause a paper jam, which may lead to a printer failure.

Figure 2:
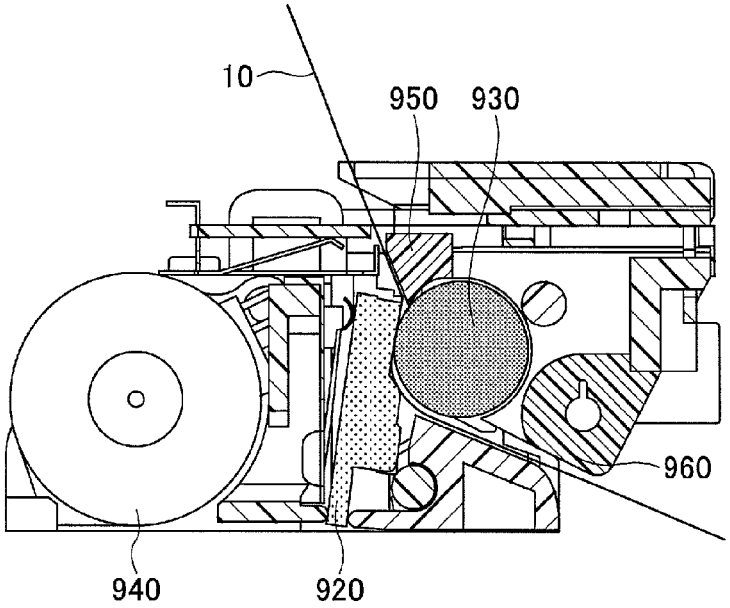
FIG. 2 is a diagram illustrating printing on a linerless label in a printer.

By way of example, the case of performing printing on the linerless label 10 illustrated in FIG. 1C using a thermal printer illustrated in FIG. 2 is described below. The thermal printer illustrated in FIG. 2 includes a thermal head 920, which is a print head, a platen roller 930, a conveying motor 940, and recording paper guides 950 and 960. The recording paper guide 950 is provided on the downstream side of the thermal head 920 in a direction to convey the linerless label 10 (referred to as the conveyance direction). That is, the recording paper guide 950 is provided on the side of the thermal head 920 to which side the linerless label 10 is discharged. Furthermore, the recording paper guide 960 is provided on the upstream side of the thermal head 920 in the conveyance direction. That is, the recording paper guide 960 is provided on the side of the thermal head 920 from which the linerless label 10 is fed to the thermal head 920 before being printed.

Printing is performed on the linerless label 10 with the linerless label 10 being held between the thermal head 920 and the platen roller 930. The conveying motor 940 rotates to rotate the platen roller 930, so that the linerless label 10 is conveyed. At this point, a front face of the linerless label 10 where the heat-sensitive layer 12 is formed is subjected to printing by the thermal head 920, and a back face of the linerless label 10 where the adhesive layer 13 is formed comes into contact with the platen roller 930. Accordingly, the linerless label 10 may adhere to the platen roller 930. Furthermore, the adhesive layer 13 of the linerless label 10 may come into contact with the recording paper guide 950 or 960 provided on the downstream side or the upstream side of the thermal head 920 in the conveyance direction. In this case, the linerless label 10 may adhere to the recording paper guide 950 or 960.

Figure 3A:
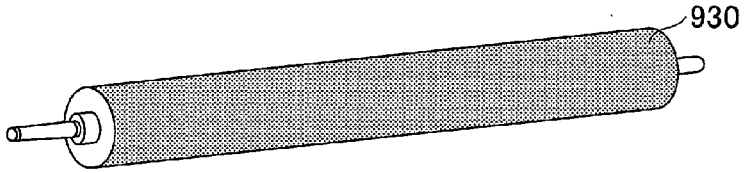
FIGS. 3A and 3B are perspective views of platen rollers compatible with linerless labels.
Figure 3B:
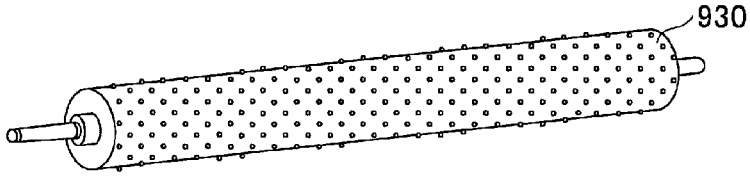

The adhesion of the linerless label 10 to the platen roller 930 may be prevented by, for example, applying a fluoropolymer on a surface of the platen roller 930 as illustrated in FIG. 3A or providing irregularities on a surface of the platen roller 930 as illustrated in FIG. 3B. As a result, it is possible to make the adhesive layer 13 of the linerless label 10 less likely to stick to the platen roller 930. As a further alternative, the adhesion of the linerless label 10 to the platen roller 930 may be prevented by providing multiple rollers so as to reduce the area of the linerless label 10 that contacts with the platen roller 930 as much as possible. Furthermore, it is possible to prevent the linerless label 10 from adhering to the recording paper guide 960 or 950 by providing multiple rollers. According to this method, however, because it is necessary to provide multiple rollers at predetermined positions, the cost and the size of the printer increase.

Therefore, there is a demand for low-cost printers capable of performing printing without an increase in size and without the adhesion of the linerless label 10.

Figure 4:
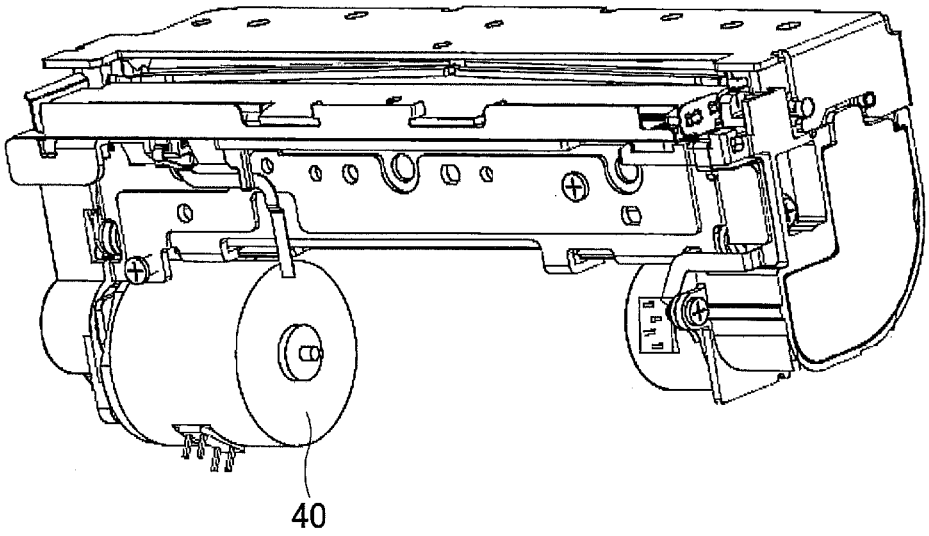
FIG. 4 is a perspective view of a printer according to an embodiment.
Figure 5:
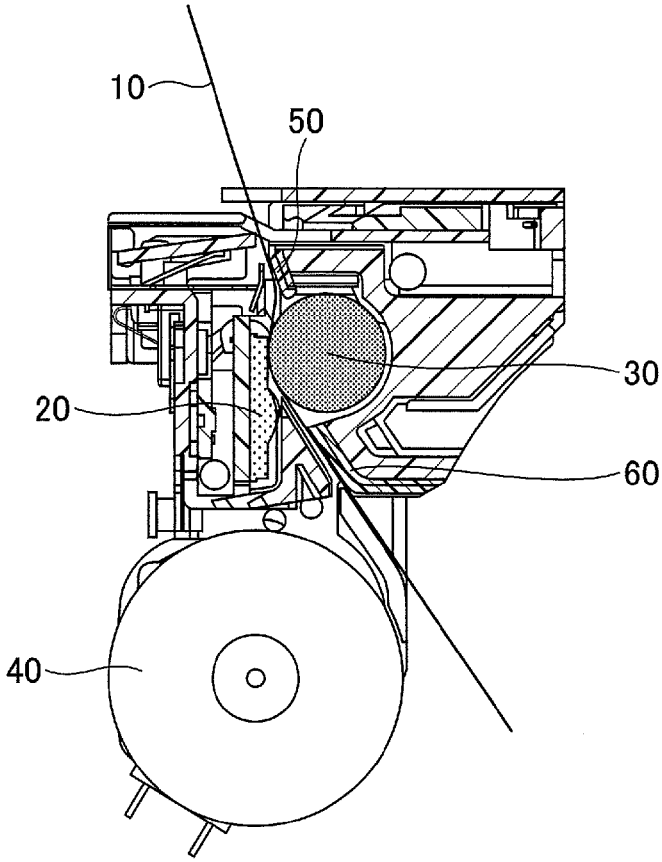
FIG. 5 is a cross-sectional view of the printer according to the embodiment.

Next, a printer according to an embodiment is described. FIG. 4 is a perspective view of the printer according to this embodiment. FIG. 5 is a cross-sectional view of the printer according to this embodiment. Referring to FIGS. 4 and 5, the printer of this embodiment includes a thermal head 20 that serves as a print head, a platen roller 30, a conveying motor 40, and recording paper guides 50 and 60. A part of the platen roller 30 that comes into contact with the linerless label 10 is formed of rubber or the like.

The recording paper guides 50 and 60 are formed of a resin material such as plastic. The recording paper guide 50 is provided on the downstream side of the thermal head 20 in the conveyance direction. That is, the recording paper guide 50 is provided on the side of the thermal head 20 on which the linerless label 10 is discharged. The recording paper guide 60 is provided on the upstream side of the thermal head 20 in the conveyance direction. That is, the recording paper guide 60 is provided on the side of the thermal head 20 from which the linerless label 10 is fed to the thermal head 20.

Printing is performed on the linerless label 10 with the linerless label 10 being held between the thermal head 20 and the platen roller 30. The conveying motor 40 rotates to rotate the platen roller 30, so that the linerless label 10 is conveyed. The front face of the linerless label 10 is subjected to printing by the thermal head 20, and the back face of the linerless label 10 comes into contact with the platen roller 30.

Figure 6:
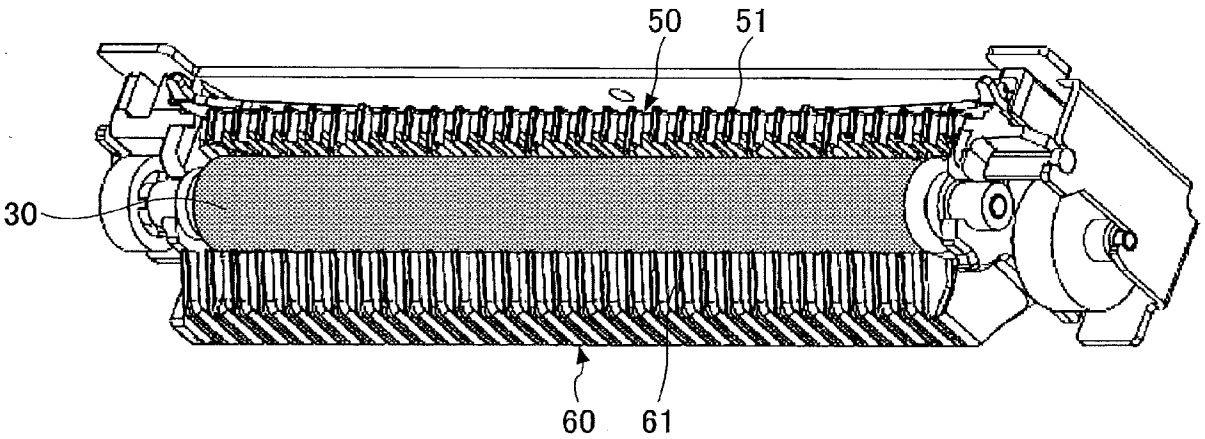
FIG. 6 is a diagram illustrating the printer according to the embodiment.
Figure 7:
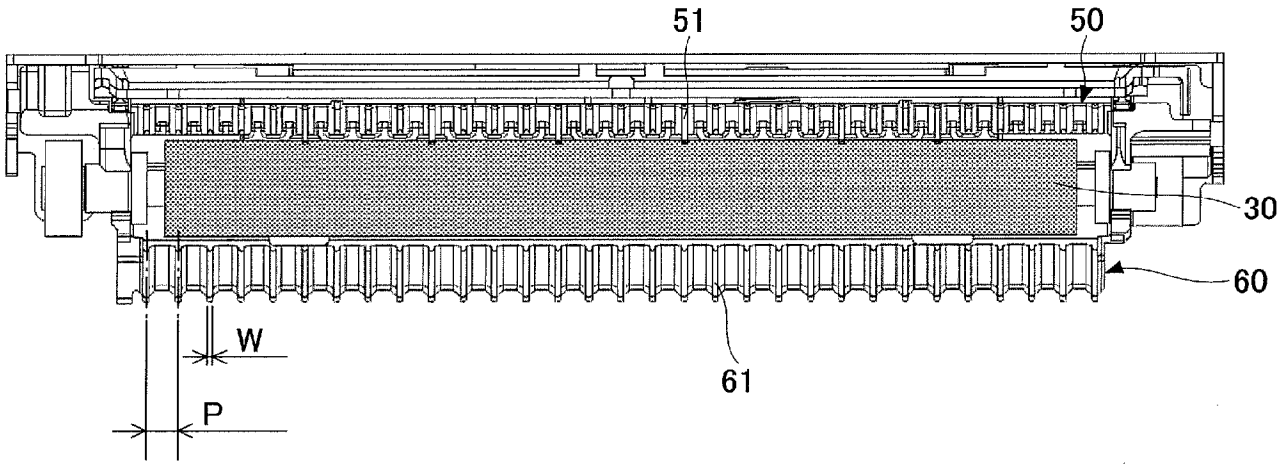
FIG. 7 is a diagram illustrating the printer according to the embodiment.

FIG. 6 is a perspective view of part of the printer that includes the recording paper guides 50 and 60 and the platen roller 30, and FIG. 7 is a plan view of the part of the printer illustrated in FIG. 6.

According to this embodiment, as illustrated in FIGS. 6 and 7, projections 51 elongated in the conveyance direction of the linerless label 10, which is the direction in which the linerless label 10 is conveyed, are formed on a surface of the recording paper guide 50. Furthermore, projections 61 elongated in the conveyance direction of the linerless label 10 are formed on a surface of the recording paper guide 60. The recording paper guides 50 and 60 are formed so that the direction in which the projections 51 and 61 are elongated is substantially perpendicular to a longitudinal direction of the platen roller 30.

Surfaces of the projections 51 and 61 are formed to be flat so as to minimize friction. According to this embodiment, as the projections 51 and 61 are elongated in the same direction as the conveyance direction of the linerless label 10, it is possible to convey the linerless label 10 in such a manner as to slide on the surfaces of end portions of the projections 51 and 61. The recording paper guides 50 and 60 are provided on the same side as the platen roller 30 relative to the linerless label 10. That is, the recording paper guides 50 and 60 are provided on the back face side of the linerless label 10.

The projections 51 and 61 are formed to have a substantially trapezoidal cross-sectional shape. The projections 51 and 61 become narrower toward their respective end portions. A width W of the end portion of each of the projections 51 and 61, that is, the dimension of the end portion of each of the projections 51 and 61 in a direction perpendicular to the conveyance direction, is 0.5 mm. Furthermore, a pitch P of the projections 51 and 61 in a direction perpendicular to the conveyance direction of the linerless label 10 is 2.6 mm. According to the printer of this embodiment, the number of projections 51 formed in the recording paper guide 50 is thirty, and the number of projections 61 formed in the recording paper guide 60 is thirty.

In the recording paper guides 50 and 60, a narrower end portion is more preferable, because the linerless label 10 becomes less likely to adhere to the recording paper guides 50 and 60 as the area of the end portions that contact the linerless label 10 becomes smaller. However, if an area of the end portion of each of the projections 51 and 61 is too small, the linerless label 10 may be damaged and is thus not preferable. Furthermore, in the recording paper guides 50 and 60, if a pitch P of the projections 51 and 61 is too small, the linerless label 10 may adhere to the recording paper guides 50 and 60 and is thus not preferable. On the other hand, if a pitch P of the projections 51 and 61 is too wide, the linerless label 10 may come into contact with and adhere to the bottom of the recess between projections 51 or the bottom of the recess between projections 61, and is thus not preferable.

In view of the above, according to the printer of this embodiment, the width W of the end portion of each of the projections 51 and 61 is preferably greater than or equal to 0.1 mm and less than or equal to 5 mm, more preferably, greater than or equal to 0.3 mm and less than or equal to 3 mm, and still more preferably, greater than or equal to 0.5 mm and less than or equal to 1 mm.

Furthermore, the pitch P of the projections 51 and 61 is preferably greater than or equal to 1 mm and less than or equal to 10 mm, and more preferably, greater than or equal to 2 mm and less than or equal to 5 mm.

The ratio of the pitch P to the width W is preferably greater than or equal to 3 and less than or equal to 20, and more preferably, greater than or equal to 5 and less than or equal to 15.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a platen roller that rotates to convey a recording sheet;

a print head that performs printing on the recording sheet; and a first recording sheet guide and a second recording sheet guide that are provided on a same side as the platen roller relative to the recording sheet, wherein a plurality of projections is provided on a surface of the first recording sheet guide and on a surface of the second recording sheet guide, wherein the projections are elongated in substantially a same direction as a conveyance direction of the recording sheet, and wherein the first recording sheet guide is provided on a downstream side of the print head and the platen roller in the conveyance direction of the recording sheet, and the second recording sheet guide is provided on an upstream side of the print head and the platen roller in the conveyance direction of the recording sheet.

2. The printer as claimed in claim 1, wherein a pitch of the projections is greater than or equal to 1 mm and less than or equal to 10 mm.

3. The printer as claimed in claim 1, wherein a width of an end portion of each of the projections in a direction perpendicular to the conveyance direction of the recording sheet is greater than or equal to 0.1 mm and less than or equal to 5 mm.

4. The printer as claimed in claim 1, wherein a ratio of a pitch of the projection to a width of an end portion of each of the projections in a direction perpendicular to the conveyance direction of the recording sheet is greater than or equal to 3 and less than or equal to 20.

* * * * *